US006364186B1

(12) United States Patent
Gilmour et al.

(10) Patent No.: US 6,364,186 B1
(45) Date of Patent: Apr. 2, 2002

(54) BACKPACK WITH ABDOMINAL SUPPORT SYSTEM

(75) Inventors: David P. Gilmour, Hollis, NH (US); Scott D. Cummings, Bedford, NH (US); William Edward Kois, Newbury Park, MA (US)

(73) Assignee: Outdoor Medical Research LLC, Hollis, NH (US)

( * ) Notice: Subject to any disclaimer, the term of this patent is extended or adjusted under 35 U.S.C. 154(b) by 0 days.

(21) Appl. No.: 09/551,927

(22) Filed: Apr. 19, 2000

Related U.S. Application Data

(60) Provisional application No. 60/177,930, filed on Jan. 25, 2000, and provisional application No. 60/129,896, filed on Apr. 19, 1999.

(51) Int. Cl.[7] ..... A45F 3/04

(52) U.S. Cl. ..... 224/637; 224/625; 224/628; 224/642; 224/660; 224/662; 602/19

(58) Field of Search ..... 224/153, 157, 224/600, 625, 626, 627, 628, 633, 635, 637, 639, 641, 642, 661, 662; 128/961, 875, 876; 602/19; 2/338

(56) References Cited

U.S. PATENT DOCUMENTS

| | | | | |
|---|---|---|---|---|
| 1,619,513 A | | 3/1927 | Hittenberger | |
| 2,449,641 A | | 9/1948 | Cidissen | |
| 2,813,526 A | * | 11/1957 | Beebe | 602/19 |
| 3,920,008 A | | 11/1975 | Lehman | |
| D318,126 S | | 7/1991 | Woodhouse et al. | |
| 5,105,806 A | | 4/1992 | Woodhouse et al. | |
| 5,111,807 A | | 5/1992 | Spahn et al. | |
| 5,205,450 A | | 4/1993 | Derosier | |
| 5,241,704 A | | 9/1993 | Sydor | |
| 5,302,171 A | | 4/1994 | Pearson et al. | |
| 5,363,863 A | | 11/1994 | Lelli et al. | |
| 5,487,498 A | | 1/1996 | Gleason | |
| 5,547,461 A | | 8/1996 | Levis | |
| 5,564,612 A | | 10/1996 | Gregory | |
| 5,609,279 A | * | 3/1997 | O'Shea | 224/160 |
| 5,676,293 A | | 10/1997 | Farris | |
| 5,762,251 A | | 6/1998 | Gleason | |

FOREIGN PATENT DOCUMENTS

FR 2589723 A1 11/1985

OTHER PUBLICATIONS

PCT/US00/10667 ISA Search Report (5 pages) dd Jul. 10, 2000.

Morris et. al., Role of the Trunk in Stability of the Spine, Journal of Bone and Joint Surgery, Apr. 1961.

Troup, Biomechancis of the Vertebral Column, Physiotherapy, vol. 65, No. 8.

Nachemson et. al., Mechanical Effectiveness Studies of Lumbar Spine Orthoses.

Marras et. al., Intra–Abdominal Pressure During Trunk Extension Motions, Clinical Biomechanics, vol. 11, No. 5, 1996.

(List continued on next page.)

*Primary Examiner*—Gregory M. Vidovich
*Assistant Examiner*—Maerena W. Brevard
(74) *Attorney, Agent, or Firm*—Vernon C. Maine; Scott J. Asmys

(57) ABSTRACT

A backpack or back borne load carrier system with abdominal support, providing both internal and external modes of back borne load support to increase an individual's load bearing capacity. An abdominal support pad and pelvic belt system is attached to a conventional backpack or equivalent load carrier system equipped with shoulder straps, to cause a portion of the load weight that would otherwise be supported directly by the shoulders and spinal column to be transferred to the pelvic region for additional external support, and to the abdominal trunk region for additional internal support through enhancement of the natural hydraulic muscle action of the abdomen in support of the loaded spinal column.

20 Claims, 11 Drawing Sheets

OTHER PUBLICATIONS

Pearcy, Biomechanics of the Spine, Current Orthopaedics, 1989.

Woodhouse et. al., Effects of Back Support on Intra–Abdominal Pressure and Lumbar Kinetics during Heavy Lifting, Human Factors, 1995, vol. 37(3).

Affidavit of Arthur Cummings dated Mar. 22, 2000.

Affidavit of Gerry Gartner dated Mar. 20, 2000.

Affidavit of Arthur Whitty dated Apr. 12, 2000.

Affidavit of Joe Litwin dated Apr. 6, 2000.

Affidavit of Tim Desclos dated Mar. 20, 2000.

Affidavit of George Wright dated Mar. 20, 2000.

Affidavit of Roger Saunders dated Mar. 18, 2000.

Affidavit of Douglas Cummings dated Mar. 23, 2000.

Affidavit of Colleen Cummings dated Mar. 23, 2000.

Affidavit of Jonathan T. Gilmour dated Nov. 24, 2000.

Affidavit of David P. Gilmour dated Nov. 24, 2000.

4 completed questionnaires entitled *Pot–Holder Questionnaire (Before Use), unsigned, undated.*

4 completed questionnaires entitled *Pot–Holder Questionnaire (After Use), unsigned, undated.*

* cited by examiner

BACKPACK WITH ABDOMINAL SUPPORT SYSTEM

This application claims priority to pending U.S. applications Ser. Nos. 60/129,896, filed Apr. 19, 1999, and 60/177,930, fled Jan. 25, 2000, by the same inventors.

BACKGROUND OF THE INVENTION

1. Technical Field of the Invention

This invention relates to devices for aiding in weight distribution and support of back borne loads, and more particularly to adding internal, load bearing support to the spine and shoulders through application of abdominal wall pressure, to the external load support provided by a hip belt and backpack load carrier.

2. Background Art

Man's skeletal and muscle structure, upright carriage, and bipedal mode of locomotion, whether walking or running, requires a large degree of freedom of shoulder, back, arm and hip movement to facilitate a coordinated gait and maintain balance. This is particularly true for traveling a significant distance and for traversing other than a level surface. A healthy person is generally capable of lifting and transporting in his or her arms roughly up to about one half of his or her own weight for short distances.

It is common knowledge that the load bearing capacity of a person can be greatly enhanced by placing the load on their back, and more specifically, by the use of a backpack load carrier. A backpack can be minimally described as a container or load of any sort that is equipped with straps by which it can be attached to a person's back. The straps may be attached to the load or pack by only one end, being then disposed over one or both shoulders and grasped and held at the user's chest.

More commonly, in order to keep the hands and arms free for coordinated walking motion and other uses, the other end of the strap or straps are attached at a lower point on the load as a shoulder strap, so as to distribute the pack load between the two attach points. Where there are two straps, the upper and lower attach points are likely to be spaced apart, equal distance from the centerline of the load or pack. The length of the two straps are typically adjusted to about the same, depending on the user's normal posture and carriage, so that the pack is more or less laterally centered on the back.

Backpacks are common gear for hikers, in particular. They are used to carry equipment and food for the hiker on trips extending from short day trips through a city park to rigorous overnight trips through remote wilderness areas where the right equipment can be vital to the hiker's survival. The longer and more remote the route of the trek and the more rigorous the terrain, the more important it is for the backpack to be as comfortable as possible for the hiker.

A common, secondary source of support for the weight of a shoulder strap backpack is the additional use of a hip belt, to which the backpack is also attached. The hip belt, utilized in conjunction with the shoulder straps to shift part of the load directly to the hips or pelvic region, decreases the weight bearing directly on the shoulders and skeletal spine.

This mode of augmented support of the back borne load is commonly accomplished by suspending the backpack on the hiker's back with two padded shoulder straps and using an adjustable hip belt which encircles the hiker's pelvis and is joined in the front of the hiker's abdomen with a belt buckle; the shoulder straps and hip belt being attached to the backpack. The hip belt serves to transfer a portion of the weight of the backpack to the pelvis of the hiker, while the shoulder straps both bear weight and secure the load to the hiker's back. In so doing, much of the weight of the backpack is now supported by the pelvis of the hiker through the external attachment of the backpack to the hip belt, rather than by the hiker's skeletal spine.

However, for the hip belt to transfer the weight effectively from the backpack to the pelvis, the hip belt must be worn snugly around the user, necessarily impinging on the hiker's pelvis. For this reason, the strap or web portion of the hip belt covering the hips, is often made somewhat wider than a common trouser belt, typically two or three inches wide in order to distribute the weight bearing on the pelvic region. Adding some width to the hip belt alleviates the problem to some extent, but does not completely prevent the hip belt from impinging on the pelvis. Making the web or strap portion of the belt much wider than two or three inches restricts the hikers maneuverability and reduces the belt's utility.

However, extra width in the web section of the belt does nothing to prevent a hard belt buckle on what is typically a narrower front section of the belt, from pressing into the abdomen. Buckle padding, where provided, is generally soft and flexible and only slightly oversize compared to the buckle. This relieves only the sharpness or hard edges of the buckle hardware. Loosening or opening the belt in an effort to decrease discomfort from either or both of the impinging buckle in the abdomen or the rubbing and riding web section of the belt on the hips, results in more or all of the load being carried by the shoulder straps, placing the load back onto the spine and defeating the benefit of the hip belt.

Pads are often added to the back and sides of the hip belt to further reduce the pressure around the pelvis. Some pads extend from the back of the hiker, around to the hiker's Anterior/Superior Iliac Spines (ASIS) of the pelvis. The ASIS form the bony landmarks in the front of the pelvis on either side of the abdomen. If the pads extend much past the ASIS, the hip belt becomes difficult to adjust and may not be able to be properly tightened around the hiker's pelvis.

Beyond the mere discomfort and superficial sore spots associated with inadequate designs and ill-fitted or improperly rigged packs with hip belts, there is the potential for causing serious injury to a healthy person bearing even a moderate load over extended distances, due to fatigue in compensating for the load and balance. The problems are amplified for persons of limited physical capacity or with pre-existing health problems affecting their load carrying capacity.

There is another class of belt type devices, not related to backpacks, used in industries and occupations where heavy front lifting is encountered, and for related athletic activities such as weight lifting. These stand-alone corsets or back braces are generally characterized as being a girth strap or belt system configured for providing broad area backside or lumbar support, and are intended to prevent or reduce the likelihood of injury to back muscles when front lifting moderate to heavy loads as in picking up and moving boxes with one's arms.

There is yet another class of belt type devices, not related to backpacks, used by the medical community in the treatment of abdominal conditions where additional support is deemed useful, such as in the containment or prevention of a possible abdominal rupture or hernia. The devices are variously known as abdominal support belts, corsets, or trusses. An abdominal support belt is minimally described as a girth strap of sufficient width or with a padded element for providing broad area support and inward pressure on the abdominal wall.

Patents and published materials on all of these arts are numerous. Patents that may provide the reader with additional context for understanding the disclosure that follows, include: Farris U.S. Pat. No. 5,676,293, issued Oct. 14, 1997, disclosing a backpack with a lumbar support and a rain hood, and claiming a "waist belt . . . to help support the backpack."; Hittenberge's U.S. Pat. No. 1,619,513; issued Mar. 1, 1927, for an abdominal support belt system with an abdominal pad that is pressed into place with encircling spring members; and Cidissen's U.S. Pat. No. 2,449,641, issued Sept. 21, 1948, for an abdominal support belt system for preventing abdominal rupture, featuring a wide belt and a lower-extending abdominal pad.

Publications that provide useful background for understanding the biomechanics of the human form factor as applied to lifting and load bearing. The article, Role of the Trunk in Stability of the Spine, by Morris, Lucas and Bressler, published in the Journal of Bone and Joint Surgery, April, 1961, describes the effect of a corset on intra-abdominal pressure and electro-myographic testing of abdominal and lumbar paraspinal muscles during lifting. Biomechanics of the Vertebral Column, by Troup, Physiotherapy, Vol. 65, No. 8, pp. 238–244, describes spinal mechanics and physiology in lifting. Mechanical Effectiveness Studies of Lumbar Spine Orthoses, by Nachemson, Schultz and Anderson, Department of Orthopedic Surgery, Sahlgren Hospital, University of Goteborg, Sweden, date of publication unknown, evaluates the physiology of lifting.

Intra-Abdominal Pressure During Trunk Extension Motions, by W. S. Marras and G. A. Mirka, Clinical Biomechanics, Vol. 11, No. 5, pp. 267–274, discusses the physiology of lifting. Biomechanics of the Spine, by M. Pearcy, Current Orthopedics, 1989, pp. 96–100, offers more discussion on the physiology of lifting. Finally, Effects of Back Support on Intra-Abdominal Pressure and Lumbar Kinetics during Heavy Lift, by M. L. Woodhouse, R. W. McCoy, D. G. Redondo, and L. M. Shall, published in Human Factors, 1995, Vol. 37(3), pp. 582–590, is a study of the biomechanical effects of weight lifting with and without lumbosacral supports.

Commercial products relating to this subject matter include the BackSaver™ 3 in 1 sport belt, a corset type support belt into which magnets, or hot and cold pacs can be inserted, and the AirTec™ backpack, a backpack with inflatable shoulder straps and an inflatable lumbar support pad but without a waist belt, both distributed by BackSaver Products Company of Holliston, Mass.

In summary, the prior art has long recognized that a hip belt attached to a shoulder strap backpack can relieve the load on a user's spine by transferring a portion of the backpack load weight from the shoulders and spine to the pelvic region via the attachment to the hip belt. Other fields of art have recognized the benefits of back braces and abdominal support belts for purposes not relating to backpacks and back borne loads. But no one has explored the biomechanics of generating internal, non-skeletal, supplemental support for a back borne load by using intentional, significant abdominal support, in combination with external support off the pelvic region.

SUMMARY OF THE INVENTION

It should be noted at the outset that the inventors have about 50 years collective experience as regular recreational hikers and backpackers, and that all of the inventors are degreed and licensed medical practitioners, with the commensurate ability to read, understand and extrapolate the results of their own experiences, testing, and study of related biomedical published materials, leading to the development of the invention disclosed herein.

It is an object of the invention to provide a mechanism for utilizing abdominal-hydraulic pressure to aid in the support of shoulder, spine and pelvic supported, back borne loads.

It is another object to provide a simple device for use with existing backpacks with hip belts, employing abdominal pressure to generate internal support of the backpack load in combination with the external load support mechanisms.

It is yet another object of the invention to provide improved hip belts for use with backpacks, employing abdominal pressure to generate internal support of the backpack load in combination with the external backpack support mechanisms.

It is a still yet further object to provide a back borne load carrier system employing abdominal pressure to generate internal support of the load in combination with the external load support mechanisms.

These objectives are met with, simply stated, a backpack load carrier system with abdominal support, providing both internal and external modes of back borne load support to increase an individual's back bearing load capacity and to reduce the likelihood of injury from carrying a loaded backpack.

In accordance with the invention, structure assuring significant abdominal support is provided for as additive to or part of a load bearing hip belt or backpack and hip belt combination, to cause a portion of the load weight that would otherwise be supported directly by the spinal column and externally off the hip belt, to be assisted by proper abdominal support and related hydraulic action through the abdominal trunk region for additional internal support of the spine and shoulders and hence of the load.

The structure providing the abdominal support may be a stand alone device for use with a hip belt and backpack, or be integrated into a load bearing hip belt or backpack and hip belt combination. In all cases, suitable structure is provided to assure that a large frontal area of abdominal pressure is applied to the user to aid the abdomen in its natural hydraulic muscle action in support of the loaded spinal column.

The principle employed in the invention is most simply explained as follows: The pelvic region, which includes the muscular walls of the back and abdomen, can be thought of as a hydraulic cylinder. The abdominal contents can be though of as the hydraulic fluid of the cylinder, providing interior support for the upper body in conjunction with the spine. The musculature of the abdominal wall completes the frontal portion of the cylinder. From another perspective, the phenomenon is somewhat analogous to the Sarmiento effect of using compressive forces on soft tissue to stabilize a long bone fracture.

The undertaking of an additional load or weight on the back, absent the invention, is automatically compensated for, initially, by a reflexive tensioning of the abdominal muscles to increase the pressure in the cylinder, allowing the bearer to retain most of his or her upright posture and carriage, while adjusting for the change in center of gravity by tilting or leaning somewhat forward.

However, this human cylinder wall is by nature flexible. Its ability to perform adequately with a load on its back is subject to fatigue, somewhat analogous to any flexible wall hose or the like that is working under pressure. In a relatively short period of time, depending on the condition of the bearer and the weight of the load, the cylinder wall begins to relax and the additional hydraulic support fades. Posture sags, stress and compression mounts on the shoulders and lower spine and pelvis, discomfort begins to be noticeable, and the potential for biomechanical stress injuries rises.

In accordance with the principles of the invention, the applicants'backpack load carrier incorporates a supplemental "cylinder" wall structure or girth strap and fall abdominal wall pad that is applied around the primary cylinder wall structure, the user's abdomen, in such a manner as to improve the efficiency and prolong the useful cycle time of the cylinder for maintaining the pressure necessary to bear the extra load, before requiring a rest. The support structure contacting the abdominal region, however implemented, covers as much of the abdominal wall as is practical to achieve the greatest hydraulic effect.

The abdominal support structure can be provided in the form of a flexible, inelastic or minimally elastic abdominal pad or belt section that is held by opposing edges or ends in tension over a substantial area of the abdominal region by an inelastic hip belt that is adjusted in length so as to bring light but noticeable pressure to bear on the abdominal wall.

Alternatively, the abdominal support structure can be provided in the form of a separate abdominal pad, utilized as a compression member under a belt, a generally oval pad fabricated with conforming surface shape and of sufficiently rigid construction by choice of material and molding techniques to be installed within the girth of a separate hip belt so as to contact and bear uniformly against a large area of the abdominal wall, and to prevent the belt and/or buckle from deforming or penetrating the pad when the belt is put in tension about the user's pelvic region. In other words, it must be sufficiently rigid to be able to uniformly distribute the belt and buckle pressure of typical hip belts uniformly across a large area of the abdominal wall.

The minimum size of the abdominal support structure, for providing meaningful internal support in the context of load carrying, characterized as a scaleable factor to fit any user, has been determined to be a length, spanwise about the user, of at least one half the distance between the bony landmarks created by the Anterior/Superior Iliac Spines (ASIS) of the user's pelvis. The minimum width, or height as applied to the user, is one half of the distance between the lower costal margin and the mid inguinal ligament. The device is sized and placed to avoid limiting bending at the waist and flexing at the hips. The support structure does not disturb abdominal breathing.

The girth or hip strap is connected at the back or sides to the backpack or load and is sufficiently wide and well secured above the user's hips so as to concurrently provide a degree of direct, external load support, in addition to providing its hydraulic, internally supporting effect. The abdominal support function requires that the belt be flexible to conform readily to the user's pelvic shape, but not elastic or stretchable, so that circumfrential length and average abdominal pressure can be maintained during normal body motion and flexure. The dual functionality of the invention in providing both internal and external support will be readily apparent in the description of the preferred embodiments and claims that follow.

Other objects and advantages of the present invention will likewise become readily apparent to those skilled in this art from the following detailed description, wherein we have shown and described several preferred embodiments of the invention, simply by way of illustration of the best modes contemplated by us for carrying out our invention.

DESCRIPTION OF THE PREFERRED EMBODIMENT

There is within the scope of the invention a range of embodiments specifically directed to use of a backpack with shoulder straps in combination with an attached abdominal support belt, where the belt provides both hydraulic support through the user's abdominal wall and trunk of a portion of the weight of the backpack, and direct external support of the backpack by attachment directly to the belt.

The structure applied to the abdominal wall can be substantially rigid and shaped to conform to the shape of the central abdominal wall area, with soft, rolled, or padded edges for gradual periphery pressure transition, in the case where it is held in compression as a compression member under a belt rather than in tension as a component of the belt. Alternatively, the structure applied to the abdominal wall when integrated into the belt assembly as a tension member, is wide, flexible and inelastic or minimally elastic.

In the preferred rigid abdominal pad embodiments where the pad is a compression member under a belt, a hip belt attached to the backpack is used with a relatively stiff, frontal pad element shaped to cover and uniformly contact a substantial central region or area of the abdominal wall, the belt and pad element in combination providing both external direct support off the back of the belt and internal hydraulic support of the load through belt tension distributed across the pad element as pressure on the abdominal wall.

The range of length of the compression member abdominal pad embodiments is one half or more, but less than the full distance, between bony landmarks created by the Anterior/Superior Iliac Spines (ASIS) of the users pelvis, so as not to cause interference with these skeletal features. The length of the non-rigid, abdominal pad element of tension member embodiments can exceed that of the compression member, as its flexibility allows it to encompass and conform to these skeletal features without the interference of a rigid member, allowing maximum coverage of the abdominal wall area.

The width or height of the rigid, compression member abdominal pad embodiments is one half or more of the distance between the lower costal margin and the mid inguinal ligament, but not so wide as to cause interference with these skeletal features when ma y flexed. The flexible, non-rigid, tension member embodiments are somewhat less critical as to height, due to their flexibility.

Figure 1:
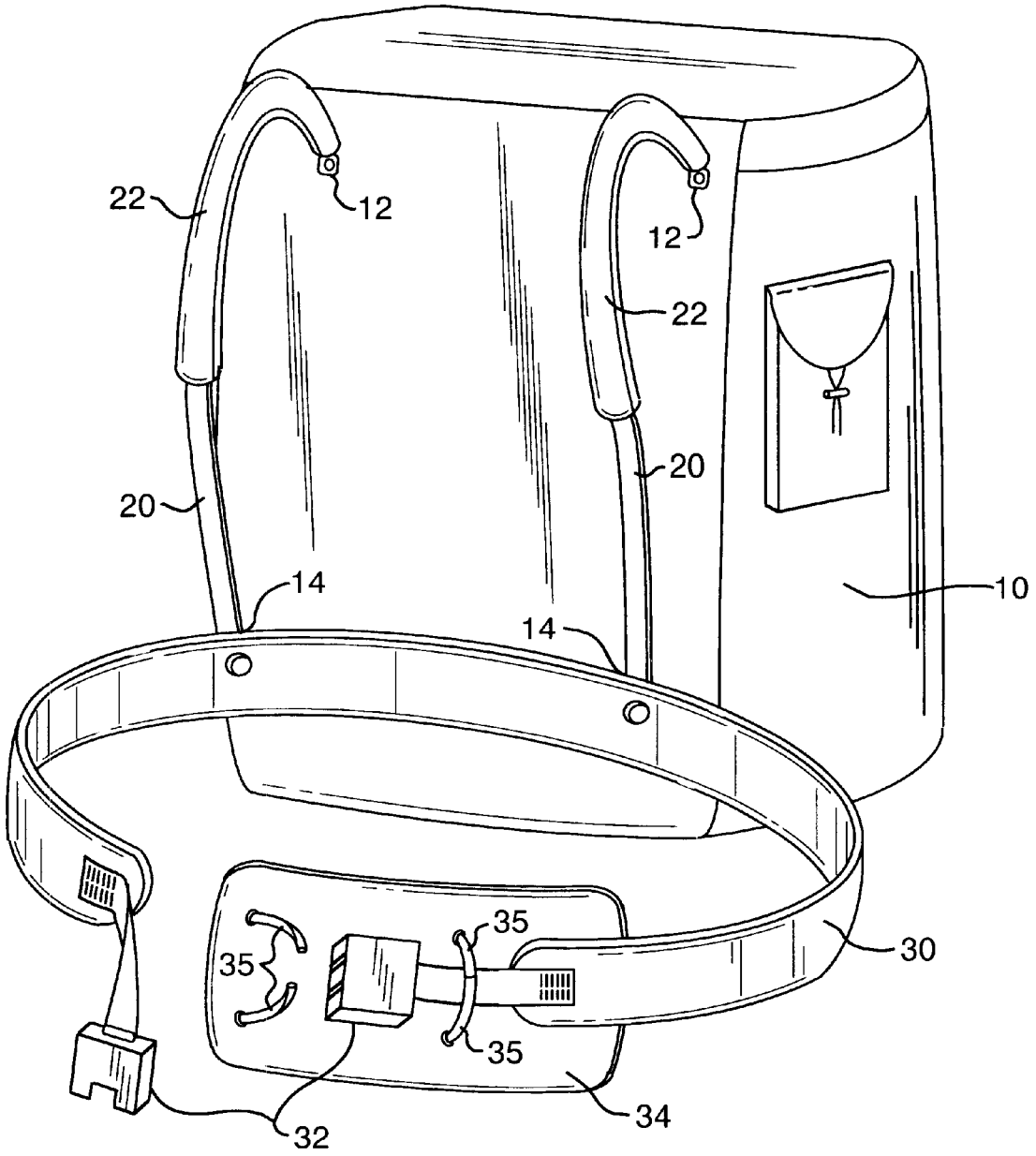
FIG. 1 is a perspective view of a preferred embodiment of a backpack system employing an attached abdominal support belt with an abdominal pad.
Figure 2:
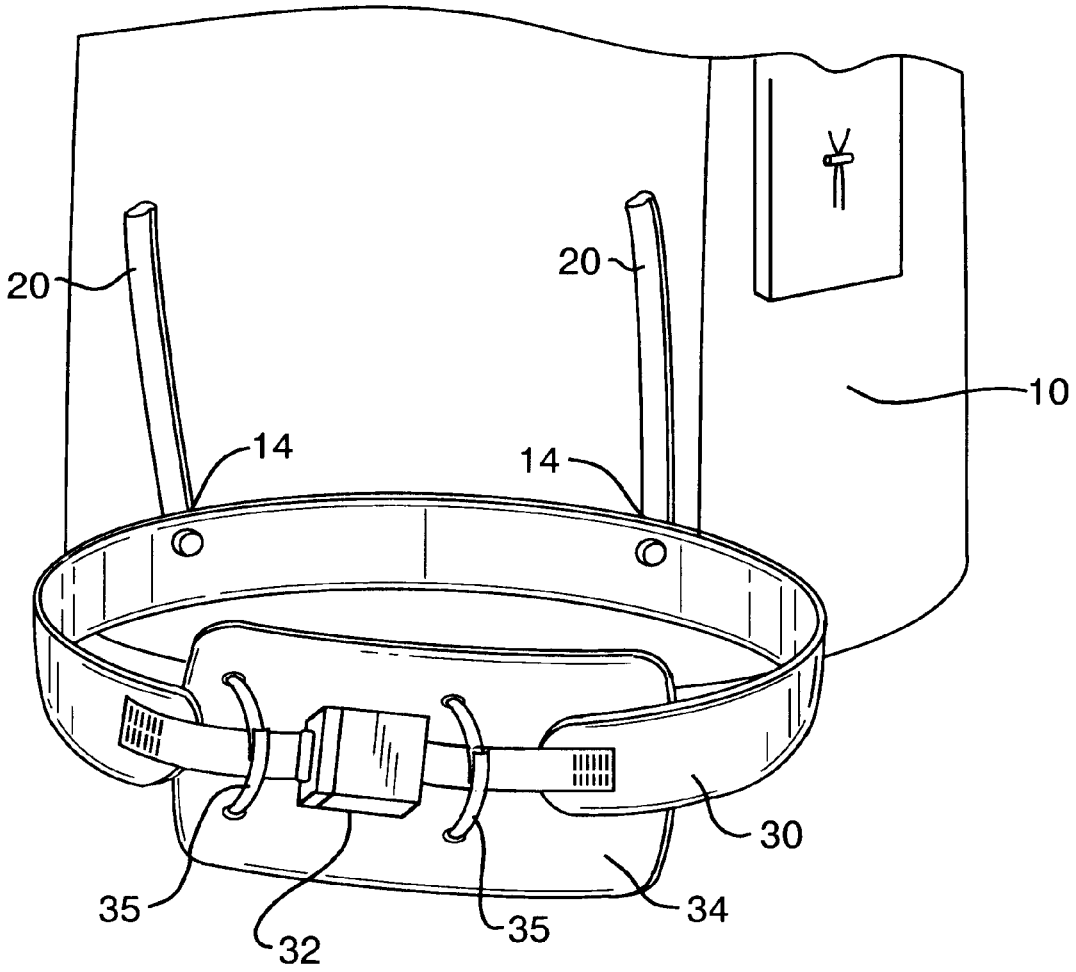
FIG. 2 is a partial perspective view of the abdominal support belt and pad of FIG. 1, showing the belt buckled, with the abdominal pad in the engaged position.

Referring to FIGS. 1 and 2, a preferred embodiment of the invention has shoulder straps 20, equipped with shoulder strap pads 22, attached to backpack 10 at points 12 and 14. Abdominal support belt 30, a flexible hip strap about three inches wide, is attached to backpack 10 at points 14. Shoulder straps 20 are adjustable in length for a comfortable fit over the shoulders of a user with backpack 10 centered on the user's back. Abdominal support belt 30 is equipped with front side tensioning strap and buckle system 32, and is of sufficient length to be wrapped snugly around the user's pelvic region and be buckled with manually applied tension.

Strap and buckle system 32 can be of any type of substantially inelastic belt end coupling mechanism that is adjustable in length and suitable to the function; and is in this embodiment a two part, snap lock plastic buckle and web strap assembly, adjustable in length, each part attached to a respective end of belt 30. Abdominal pressure pad 34 is a rigid compression member, attachable to belt 30 with loops 35, interior of tensioning strap and buckle system 32, so as to be centered over and be pressing against a user's abdomen when the belt is buckled in tension. Belt 30 is sufficiently long to overlap the edge of pad 34, the two components collectively providing a support mechanism that spans the full abdominal wall and the pelvic region. Additionally, the relatively secure circumfrential grip of the abdominal support belt component of this and other embodiments of the invention provides greater security to undesirable side play of the backpack as a user negotiates obstacles or difficult terrain.

Figure 3:
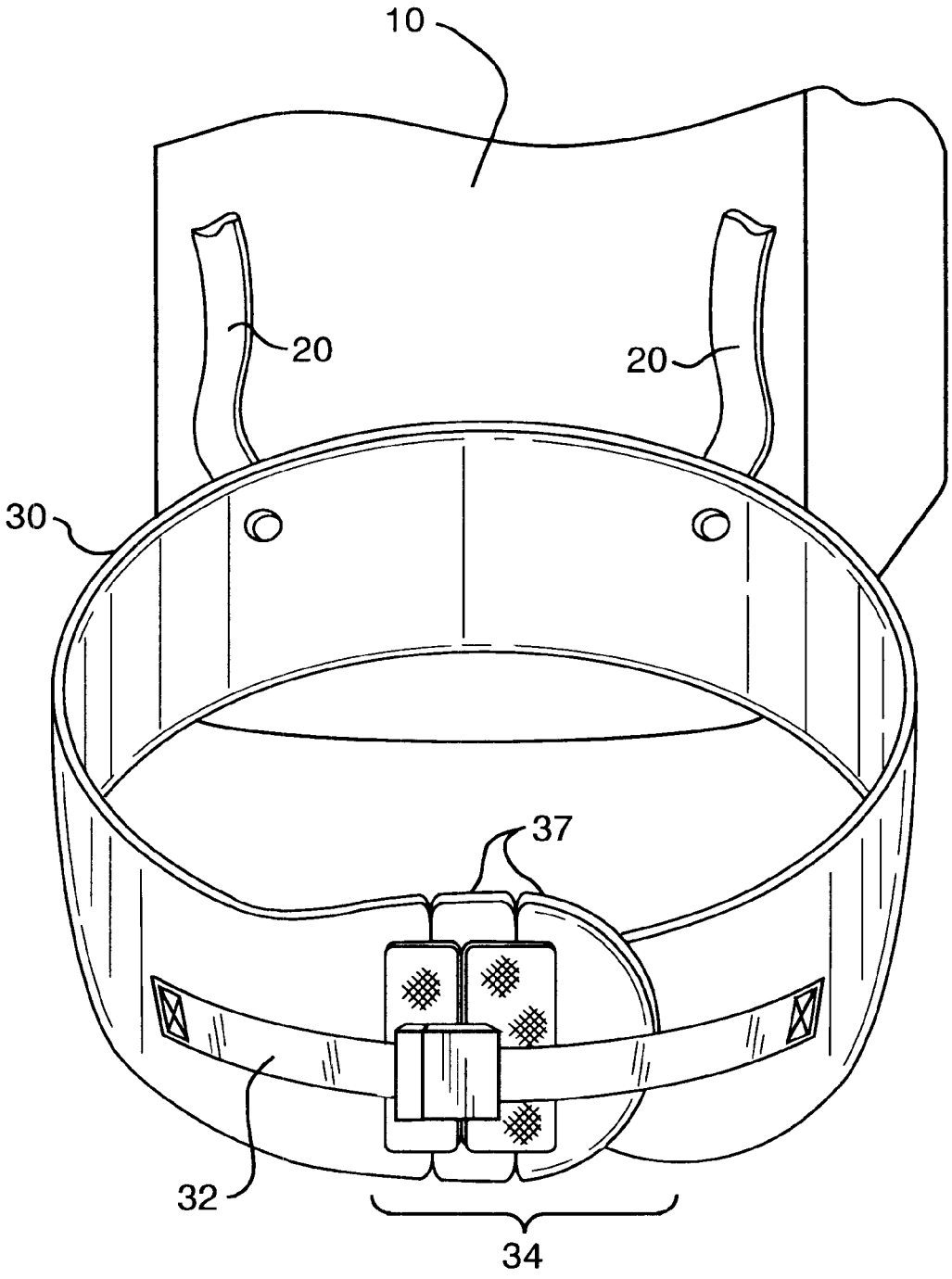
FIG. 3 is a partial perspective view of an alternative abdominal support belt to the backpack of FIG. 1, with a segmented abdominal support pad section compressed beneath an external strap and buckle assembly.

Referring to FIG. 3, alternative abdominal support belt 30 is equipped with a segmented abdominal support compression section 34, with attachable and removable abdominal segments 37 being usable to extend the length of belt 30. As in the FIG. 1 embodiment, abdominal support section 34 is attached to belt 30 and contained within the grip of tensioning and buckle system 32 so as to be in compression against the abdominal wall. Section 34 and belt 30, as in FIG. 1, collectively provide a support mechanism that spans the full abdominal wall and the pelvic region. Commonly available hook and loop fastener straps are used for inserting segments 37 in the belt to obtain the correct side of section 34 prior to buckling up.

Figure 4:
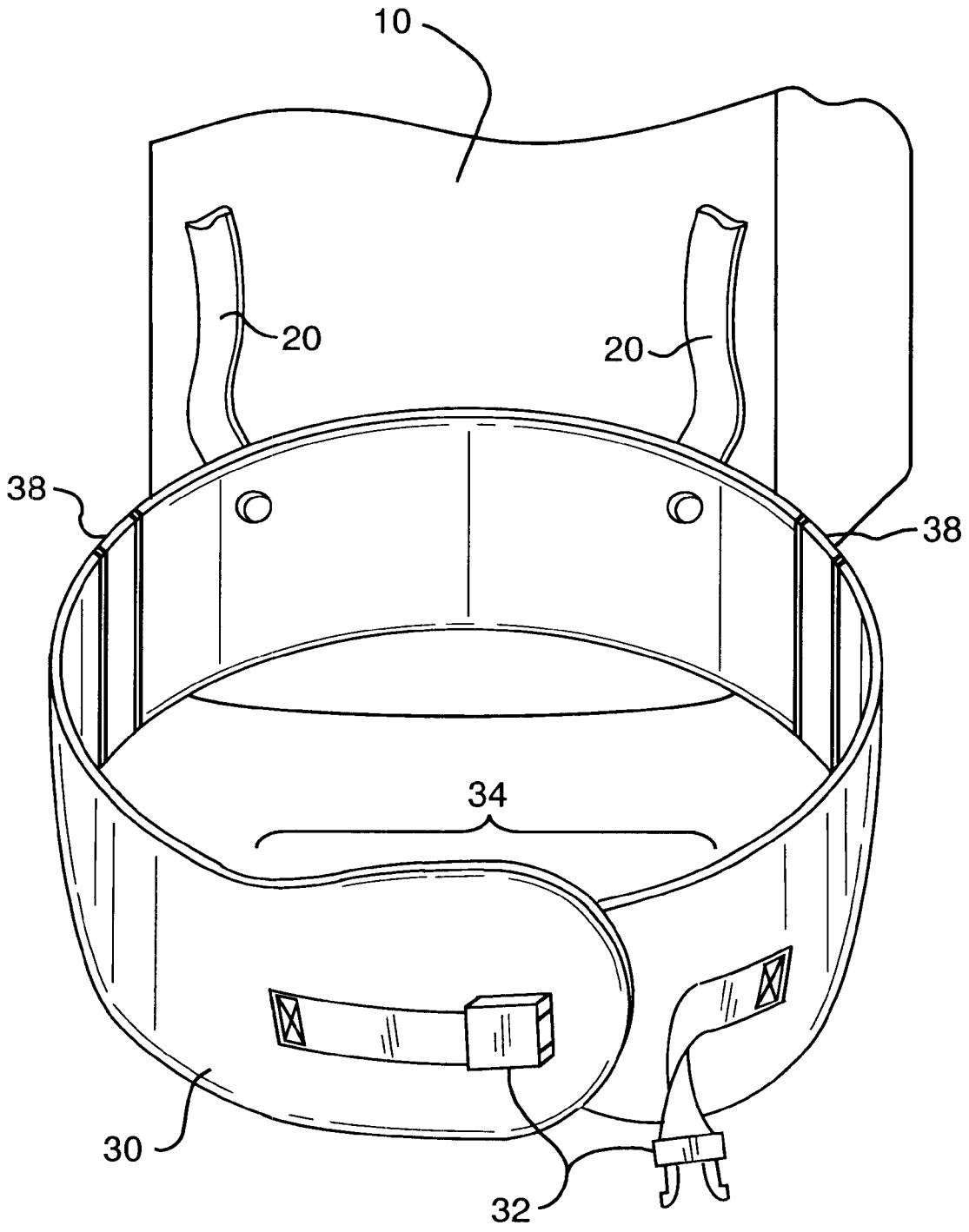
FIG. 4 is partial perspective view of another alternative abdominal support belt to the backpack of FIG. 1, with belt segments inserted as tension members in the sides of the belt, and an abdominal support section compressed beneath an external strap and buckle assembly.

This is only one example of means within the scope of the invention for fitting the support belt to a particular user. Referring to FIG. 4, another alternative abdominal support belt 30, is configured for insertion of belt side segments 38, for adjusting the length of the belt. Belt side segments 38 are attachable to belt 30 with commonly available hook and loop fastener straps sufficient to carry the full tension of belt 30 when buckled and in use. Abdominal support section 34 is again a compression member, uniformly distributing the pressure from strap and buckle system 34 against the abdominal wall.

Figure 5:
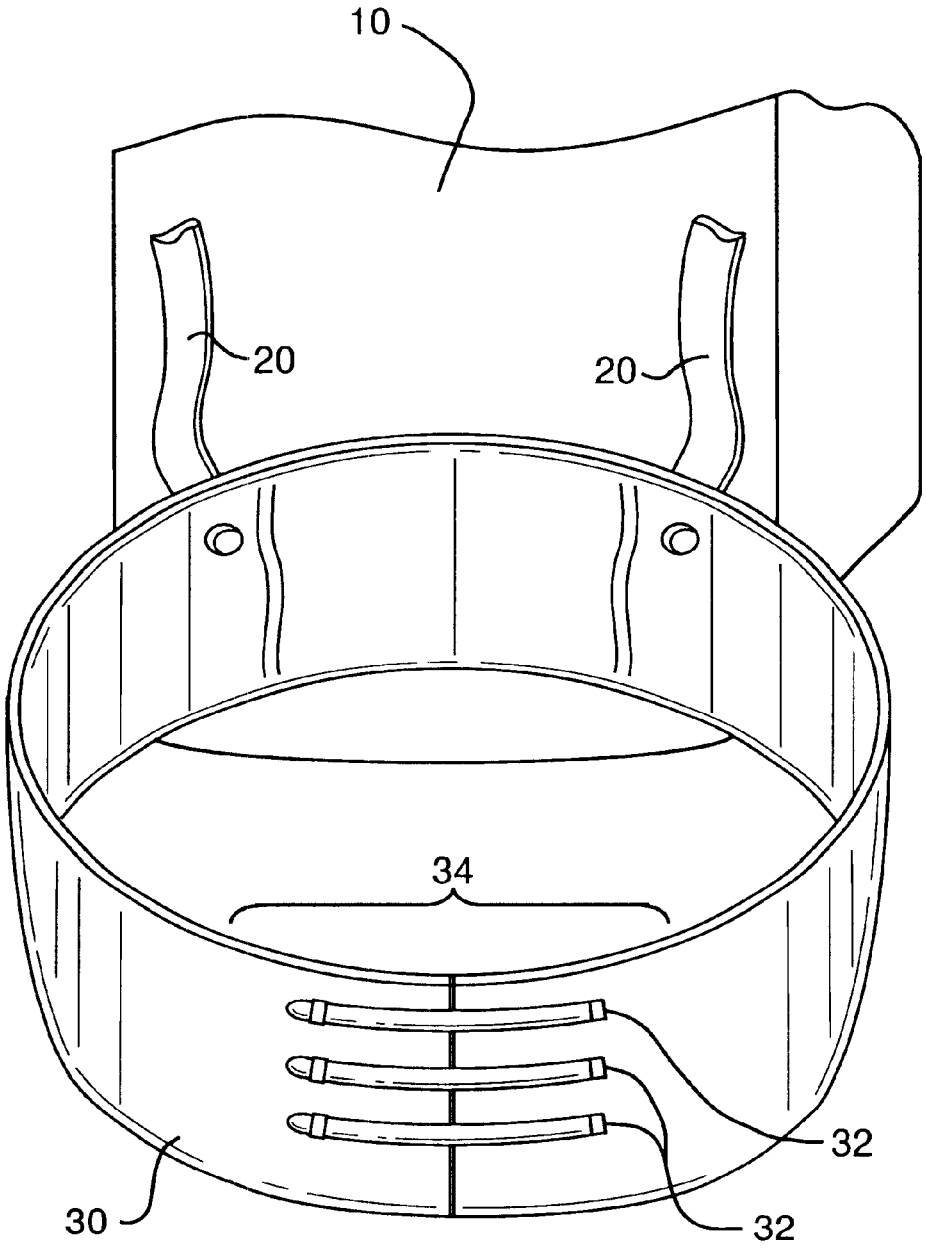
FIG. 5 is a partial perspective view of still another alternative abdominal support belt to the backpack of FIG. 1, with an integral belt and abdominal pad secured with multiple parallel tensioning straps and buckles external to the abdominal pad.

Referring to FIG. 5, still another alternative abdominal support belt 30 is configured with a wide set of multiple, parallel tensioning straps and buckle assemblies 32. The width of the strap and buckle assembly permits the use of a flexible abdominal support section 34, which is a continuous element of belt 30 in this embodiment. The length of the parallel tensioning straps provides for adjustment to the effective length of the belt.

Figure 6:
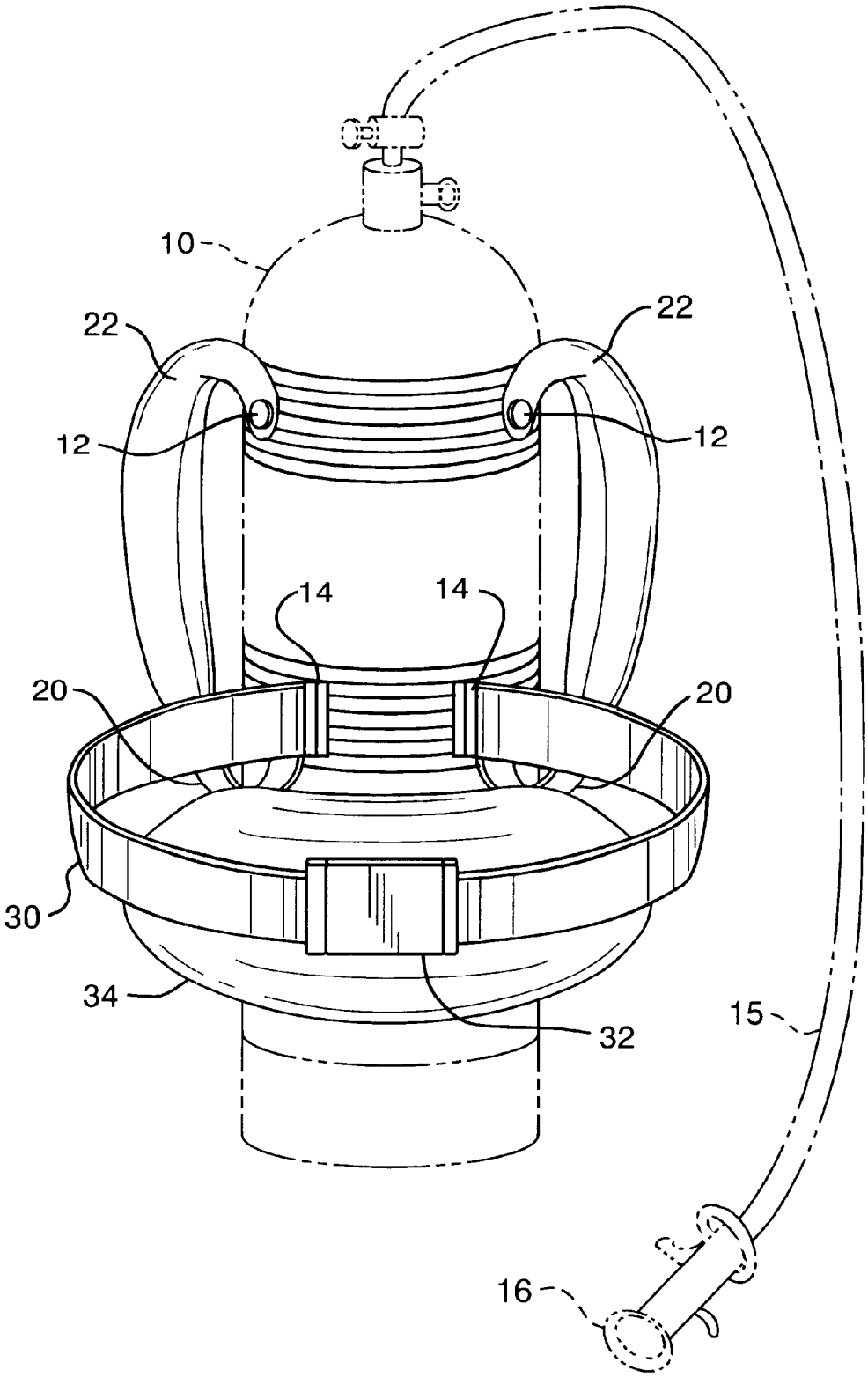
FIG. 6 is a perspective view of a tank sprayer configured for carriage as a backpack in accordance with the invention, with shoulder straps and an attached abdominal support belt.

Referring to FIG. 6, tank sprayer 10 has shoulder straps 20, equipped with shoulder strap pads 22, attached to tank sprayer 10 at points 12 and 14. Abdominal support belt 30 is attached to tank sprayer 10 at points 14. Shoulder straps 20 are adjustable in length for a comfortable fit over the shoulders of a user with tank sprayer 10 centered on the user's back. Abdominal support belt 30 is equipped with front side tensioning strap and buckle system 32, and is of sufficient length to be wrapped snugly around the user's pelvic region and be buckled with manually applied tension. Abdominal pressure pad 34 is attachable to belt 30, interior of tensioning strap and buckle system 32, so as to be centered over and be pressing against a user's abdomen when the belt is buckled in tension. Hose 15 is sufficiently long that nozzle 16 is easily grasped and operated with user's hands. As in other embodiments, the circumfrential grip of the abdominal support belt aids greatly in restricting undesirable side play of the tank sprayer while the user is in motion.

It will be readily apparent to those skilled in the art from the above descriptions that the invention is highly adaptive to applications requiring an extra degree of security in the attachment of the backpack to the user, such as framed baby carriers and power units with hand held operating heads.

Figure 7:
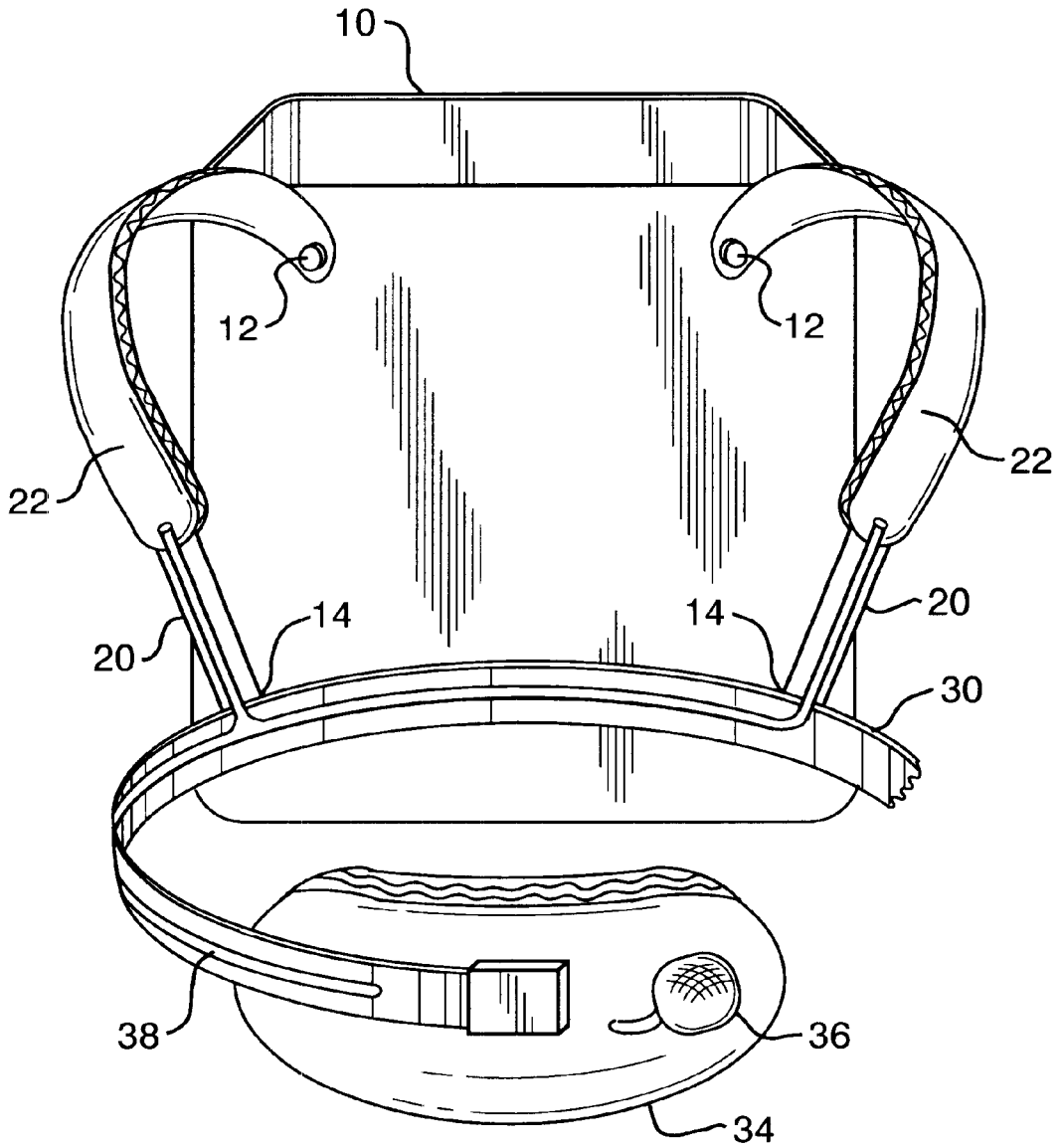
FIG. 7 is a perspective view of another preferred embodiment of the invention, a backpack with attached abdominal support belt, with pneumatic shoulder strap bladders connected to an abdominal support pad bladder, and a hand pump for pressurizing the bladders.

Referring to FIG. 7, the embodiment of FIG. 1 is modified to incorporate inflatable shoulder strap pads 22, inflatable abdominal support pad 34, and hand pump 36, all interconnected by pneumatic lines 38. Inflatable abdominal support pad 34 has a semi-rigid or rigid exterior side shell and an interior side bladder sized and shaped so that the bladder pressure is uniformly exerted against the abdominal wall. When this embodiment is loaded and fitted to a user, the common bladder system is partially inflated so as to normalize pressures at all these points of contact. Thereafter, when the user is moving with hips and shoulders in motion, the bladder system automatically responds to changes in pressure, permitting air, or such other fluid as may be used in the system, to flow from the bladders under higher pressure to the other bladders, as for example from the shoulder strap bladders to the abdominal bladder, to maintain the original balance of the shoulder strap and abdominal pressure and support.

Alternatively, each or any bladder may be connected and individually pressurized with the common pump or its own pump to a desired firmness with air or other compressible fluid so as to provide a unitary air cushion effect at the specific contact area for that bladder.

The inflatable abdominal support pad 34 may be alternately constructed with an inner and an outer shell component, with a bladder sandwiched in between, thereby providing a performed broad area external abdominal support plate secured under compression by abdominal support belt 30, and a pre-formed semi-rigid or rigid interior side abdomen pressure plate, between which the inflated bladder exerts pressure.

Figure 8:
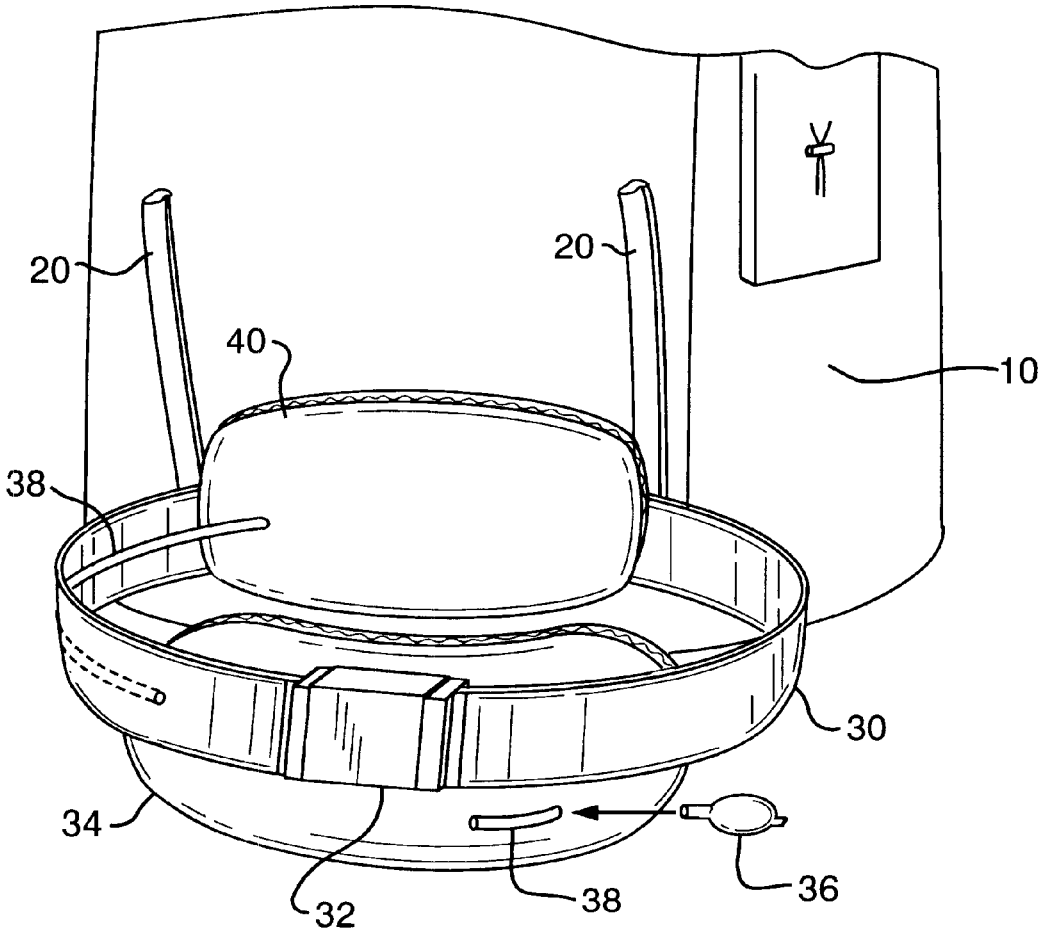
FIG. 8 is a partial perspective view of still another preferred embodiment of the invention, a backpack with attached abdominal support belt with both lumbar support pad and abdominal support pad, with interconnected inflatable abdominal pad bladder and inflatable lumbar pad bladder.

Referring to FIG. 8, the embodiment of FIG. 1 is again modified, this time to incorporate lumbar support. Lumbar support pad 40 and abdominal support pad 34 are both configured in this embodiment to be inflatable with hand pump 36, all interconnected by pneumatic lines 38. The inflatable lumbar and abdominal pads 40 and 34 again, as in FIG. 7, have preformed exterior side shells, with an air bladder interior thereof When this embodiment is loaded and fitted to a user, the common bladder system is partially inflated so as to cushion the normal pressures at these points of contact. Thereafter, when the user is moving with hips and shoulders in motion, the bladder system automatically responds to changes in pressure, permitting the flow of air, or such other fluid as may be used, from the higher pressure bladders to the lower pressure bladders, as for example from the shoulder strap bladders to the lumbar and abdominal wall bladders, to maintain the original balance of the shoulder strap and abdominal support. Alternatively, each or any bladder may be isolated from the other bladders and individually pressurized with the common pump or its own pump to a desired firmness with air or other compressible fluid so as to provide a unitary air cushion effect at the specific contact area for that bladder.

Again as in FIG. 7, inflatable lumbar and abdominal support pads 34 and 40 of FIG. 8 may be alternatively constructed with both exterior and interior pre-formed shells so as to conform to their respective body contact areas, with air bladders disposed between the inner and outer shells to provide the air cushioning, constant pressure effect.

Figure 9:
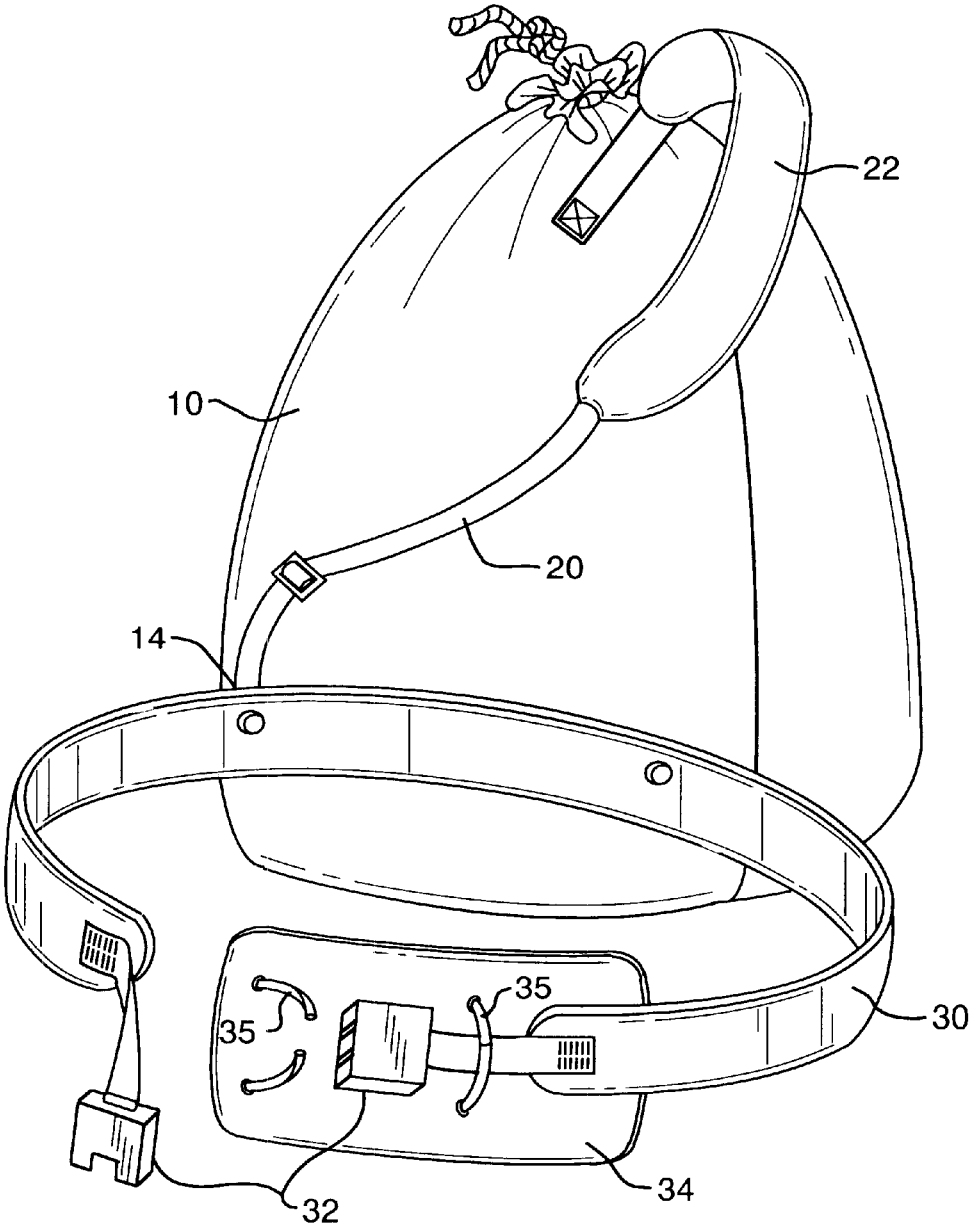
FIG. 9 is a perspective view of a one shoulder strap variation of the embodiment of FIG. 1.

Referring to FIG. 9, the invention encompasses load carriers of one or two shoulder straps, the intent being to unload the shoulder by providing internal and external support from the pelvic and abdominal regions. The FIG. 9 embodiment is analogous to the FIG. 1 in all substantive respects, except that it has only one shoulder strap that crosses the chest and attaches to the pack and hip belt at the opposite side. Some users may prefer the lower attach point be on the belt or pack on the same side as the shoulder being used, so as to be able to simply sling the pack over one arm and fasten the belt.

The simplest implementation of abdominal support is a compression pad member of firm material, such as plastic, conforming to the shape of the abdomen and having sufficient rigidity to uniformly distribute the pressure of a hip belt across the abdominal wall. The pad and its belt, attached to a backpack, child carrier, or other load-carrying device, constitutes a system of the invention. All sorts of suitable materials can be used for the pad. Holes or wicking materials can aid in ventilation and reducing sweat accumulation.

The support pad can be integrated into the pack belt as a tension member, as by having one or both belt ends expand into a wider, flexible but inelastic or minimally elastic section for covering a large area of the abdomen.

A cushioning and pressure distribution system of bladders may be added at points of contact and support of the load carrier system on the user. The bladders may be air inflatable orally or by a simple hand pump such as used with a blood pressure cuff, or may be pre-filled with other suitable fluids. The interconnecting pneumatic or hydraulic fluid lines may include simple valves permitting operation of all bladders in common mode for normalizing pressure so that additional weight on the shoulders, for example, causes additional pressure on the abdominal pad bladder.

The normalizing effect as between abdominal and lumbar support bladders illustrated in FIG. 8, can be extended to include shoulder strap bladders, as well. Single shoulder strap embodiments of the invention may also incorporate a shared bladder system. If preferred, however, any of the individual bladders may be inflated and isolated by valves to function as simple air cushions or pillows at their respective pressure points.

Figure 10:
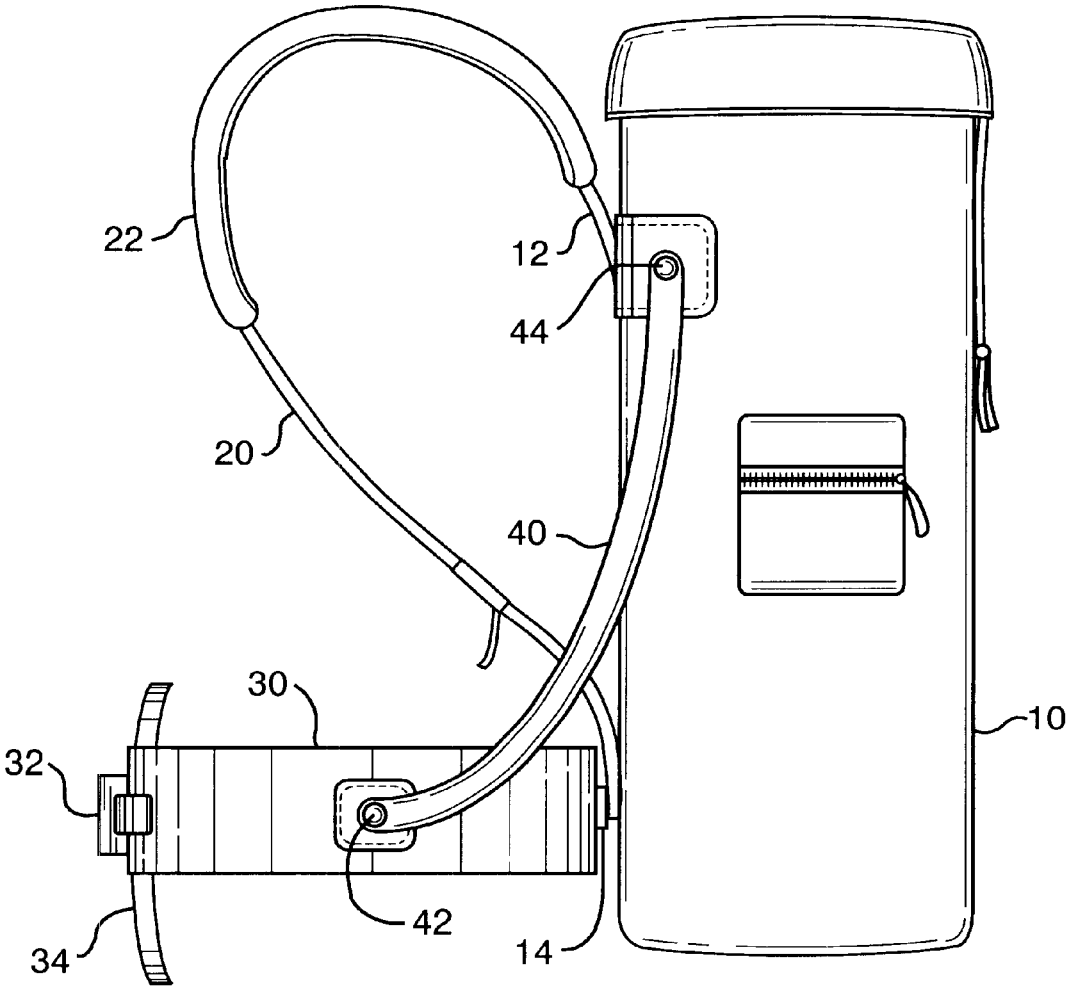
FIG. 10 is a side elevation of an abdominal support belt and backpack configured with left and right side pivotally attached external support links between the pack and the belt.
Figure 11:
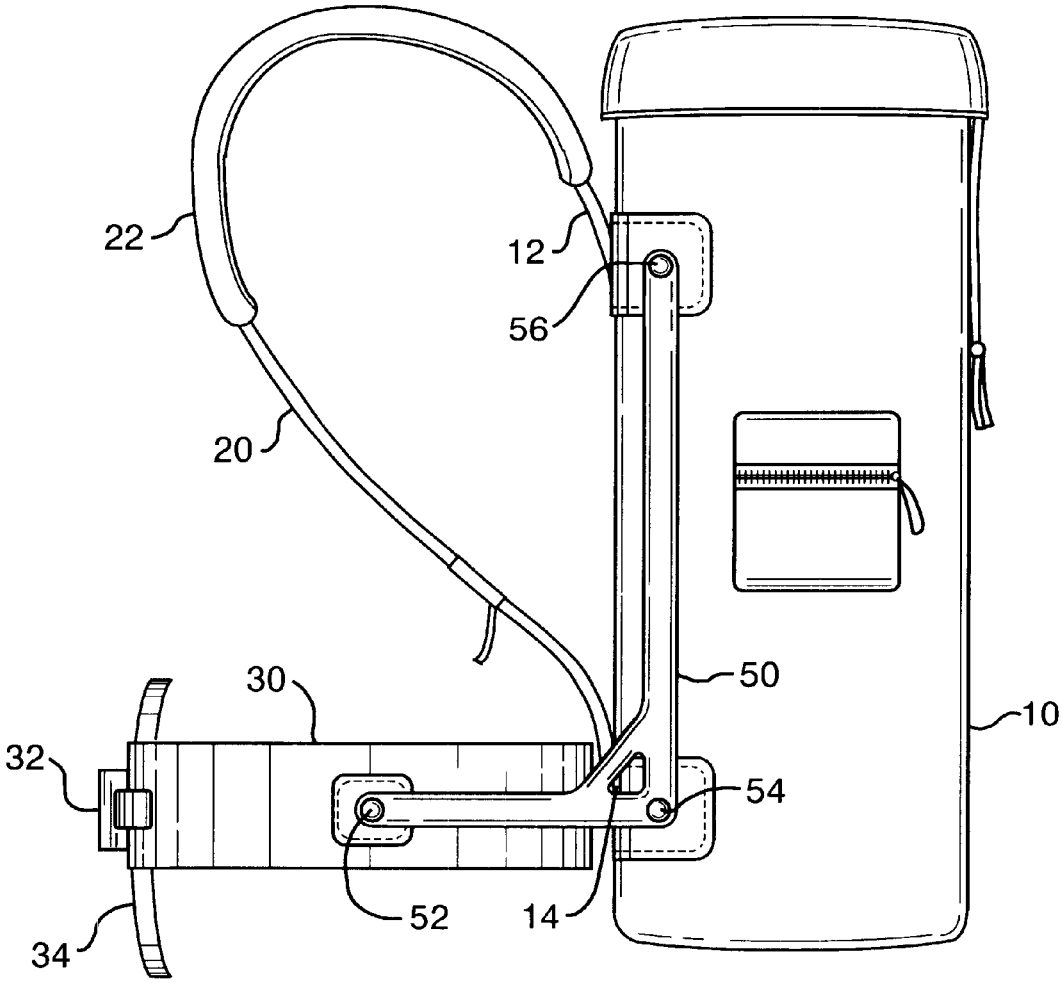
FIG. 11 is a side elevation of an abdominal support belt and backpack configured with left and right fife cantilevered external support links extending from the pack to the belt.

Referring to FIGS. 10 and 11, to the extent that external support is desired to be further distributed around the pelvic region, the attachment scheme between the pack belt and the load may include a rigid or semi-rigid link structure connecting the load and the belt. In FIG. 10, left and right side links 40 are rod members, curved for arm clearance, that are pivotally attached at respective belt attach points 42 over the hip on belt 10, and likewise pivotally attached at respective pack attach points 42. Links 40 provide an external transfer mechanism for distributing a portion of the load directly to the hip region of belt 10.

Referring to related FIG. 11, left and right side cantilevered links 50 are right angle members attached at two spaced apart points on respective sides of the pack, attach points 54 and 56, and extending from the pack to respective attach points 52 over the hip on belt 10. The other elements of FIGS. 11 and 12 are analogous to the same elements in FIG. 1.

The invention is adaptive to existing backpacks and hip belts, as simply as adding a suitable implementation of the abdominal support pad to the front of the pack belt of an existing backpack. The abdominal support pad in a compression pad embodiment will generally have a surface contoured to fit comfortably against the user's abdomen.

A basic abdominal support pad may be molded or fabricated of one or more layers of suitable material to produce a structure that is rigid enough to uniformly distribute the force exerted by the hip belt and buckle system across a large area of the abdominal wall. A typical construction may be a layer of polypropylene bonded to a layer of eucolite, although the pad can be constructed of any number or combination of materials suitable to the form and function. Such materials include but are not limited to leather, polyethylene, pe-lite, plastazote, polyethylene foam, urethane foam, aliplast, and the like. A typical size of the pad is about eight inches long and six inches wide. An abdominal support pad for adding to a user's existing equipment can be supplied in one large size and of such materials as can be then trimmed to fit the user's abdominal size.

Another variation for implementation of the invention lies in providing a pelvic belt and abdominal support pad system that is configured for ready field attachment to backpacks not otherwise configured with pack belts. Yet another variation for implementation lies in providing a pack frame with shoulder straps and pelvic belt with abdominal support pad, enabling the ready mounting to the frame of packs, slings, loads or tools of infinite variety, all to the effect of providing the combination of internal and external support of a back borne load that is unique to the invention.

Another aspect of the invention is that the abdominal support section or pad provides real estate or surface area for adding accessories or attach points for removable accessories such as a map, compass, electronic navigation unit, flash light, or gloves.

As will be realized, the invention is capable of other and different embodiments, and its several details are capable of modifications in various obvious respects, all without departing from the invention.

For example, there is within the scope of the invention, an abdominal support pad for use with a backpack with a pelvic belt, where the pad consists of a rigid, primary pad member having an inner surface and an outer surface. The length of the pad member is at least one half and less than the fill distance between bony landmarks created by the Anterior/Superior Iliac Spines (ASIS) of a user's pelvis, the width of the pad member being at least one half the distance between the user's lower costal margin and mid inguinal ligament. The inner surface of the pad member is engageable with the user's abdomen for distributing a backpack load over a relatively wide area of the user's abdomen when the belt is secured about the pelvic region. There may be a flexible skirt on the rigid pad member, extending its overall size so as to flexibly overlap the limiting skeletal features. The pad may have a way for securing the first or outer surface of the pad member to the inner side of the pelvic belt opposite said backpack.

Of course, the backpack may be a pack frame or load carrier to which or in which a user selected load may be secured, such as baby carrier, or a school or book bag, a pack basket for hunters or trappers. Alternatively, it may be any portable object or device configured with at least one shoulder strap and a pelvic belt to facilitate back borne carriage by individual persons.

The pad may include an inflatable bladder of substantially the same size as the primary pad member, with the bladder disposed on the second or inner surface of the pad member so as to be inflatable between the pad member and the user's abdomen, plus a hand pump or mouthpiece for inflating the bladder.

Another example of the invention is a pelvic belt with abdominal support for use in combination with a backpack, consisting of a belt of sufficient length to encircle the pelvic region of a backpack user, any conventional way for securing the belt about the pelvic region of the user, such as straps, buttons, hook and loop fasteners, buckles, cinches related devices. The belt has a backside attachment to the backpack which may likewise be of varied means such as, without limitation, rivets, buckles, buttons, cords, loops, hooks or other mechanical fasteners. It will include an abdominal support element positionable for broad area contact with the abdomen of the user and be held in contact under pressure when the belt is secured around the user.

The abdominal support element of the belt can be a rigid, primary pad member having an inner surface and an outer surface, where the length of the pad member is at least one half and less than the full distance between bony landmarks created by the Anterior/Superior Iliac Spines (ASIS) of a user's pelvis, and the width of the pad member is at least one half the distance between said user's lower costal margin and mid inguinal ligament. The inner surface of the pad member is engageable with the user's abdomen for distributing the backpack load over a relatively wide area of the user's abdomen when the belt is secured about the user's pelvic region. The first or outer surface of the pad member is equipped so as to be securable to the pelvic belt opposite the backpack.

There may be included in the above example a lumbar support element positionable for broad area contact with the lumbar region of the user and held in contact under pressure when the belt is fastened.

As in the pad example, the pelvic belt may have an inflatable abdominal bladder substantially the same size as the abdominal support element, with the bladder disposed between the support element and the user's abdomen, and an inflator such as a simple hand pump for inflating the bladder. And in the case of a lumbar support element, there may be an inflatable lumbar bladder of substantially the same size as the lumbar support element, with the lumbar bladder disposed between the lumbar support element and the user's lumbar region. A lumen, or fluid tube, connects the lumbar bladder and the abdominal bladder so that air or fluid can flow readily from one to the other as differential pressures vary.

As yet another example, the invention includes a weight bearing abdominal support system for back borne load carrying, consisting of a back borne load carrier equipped with at least one shoulder strap, and a belt of sufficient length to encircle the pelvic region of a user. The belt is attached to the load carrier for providing external pelvic support and has a way for buckling or being otherwise fastened around the pelvic region of the user. As in the stand alone belt embodiment, the belt of the full load carrier system is further configured with an abdominal support element positionable for broad area contact with the abdomen of the user, operating in the same fashion.

Of course the load carrier can be a backpack, a baby carrier, a school bag for books and other student articles, or any object configured with at least one shoulder strap to facilitate back borne carriage by individual persons.

Additionally, the weight bearing abdominal support system can be configured with an inflatable abdominal bladder system as previously described. There may be two shoulder straps, and the shoulder straps may fitted with inflatable bladders arranged so as to contact and cushion the shoulders of the user, under the straps, when the system is donned, with a lumen connecting all the bladders so that air or fluid passes readily between the bladders depending on pressure. A lumbar support pad and lumbar pad bladder may likewise be incorporated.

As a further example, the weight bearing abdominal support system's belt can be attached to the load carrier by left and right side pivotally connected external load link, or by left and right side load link attached to the backpack so as to be cantilevered out to attach to either side of the belt, so as to provide additional external support to the load off the pelvic region.

The objects and advantages of the invention may be further realized and attained by means of the instrumentalities and combinations particularly pointed out in the appended claims. Accordingly, the drawing and description are to be regarded as illustrative in nature, and not as restrictive.

We claim:

1. An abdominal support pad for use with a backpack with a pelvic belt, said pad comprising: a rigid, primary pad member having an inner surface and an outer surface, the length of said pad member being at least one half and less than the full distance between bony landmarks created by the Anterior/Superior Iliac Spines (ASIS) of a user's pelvis, the width of said pad member being at least one half the distance between said user's lower costal margin and mid inguinal ligament, said inner surface of said pad member being engageable with user's abdomen for distributing a backpack load over a relatively wide area of said user's abdomen when said belt is secured about said user's pelvic region, means for securing a first surface of said pad member to the pelvic belt opposite said backpack.

2. The abdominal support pad of claim 1, said backpack being a pack frame to which a user selected load may be secured.

3. The abdominal support pad of claim 1, said backpack being any object configured with at least one shoulder strap and a pelvic belt to facilitate back borne carriage by individual persons.

4. The abdominal support pad of claim 1, said abdominal support pad further comprising:

an inflatable bladder of substantially the same size as said primary pad member, said bladder disposed on said second surface of said pad member so as to be inflatable between said pad member and said user's abdomen, an inflator for inflating said bladder.

5. A pelvic belt with abdominal support for use in combination with a backpack, comprising:

a belt of sufficient length to encircle the pelvic region of a backpack user, means for securing said belt about said pelvic region of said user, means for backside attachment of said belt to said backpack, and an abdominal support element positionable for broad area contact with the abdomen of said user and held in said contact under pressure when said means for securing is operated, said abdominal support element being a primary pad member having an inner surface and an outer surface, the length of said pad member being at least one half and less than the full distance between bony landmarks created by the Anterior/Superior Iliac Spines (ASIS) of a user's pelvis, the width of said pad member being at least one half the distance between said user's lower costal margin and mid inguinal ligament, said inner surface of said pad member being engageable with user's abdomen for distributing a backpack load over a relatively wide area of said user's abdomen when said belt is secured about said user's pelvic region.

6. The pelvic belt with abdominal support of claim 5, further comprising a lumbar support element positionable for broad area contact with the lumbar region of said user and held in said contact under pressure when said means for securing is operated.

7. The pelvic belt with abdominal support of claim 6, further comprising an inflatable lumbar bladder of substantially the same size as said lumbar support element, said lumbar bladder disposed between said lumbar support element and said user's lumbar region, an inflatable abdominal bladder of substantially the same size as said abdominal support element, said abdominal bladder disposed between said abdominal support element and said user's abdomen, and means for inflating said bladders.

8. The pelvic belt with abdominal support of claim 5, said backpack being a school bag.

9. The pelvic belt with abdominal support of claim 5, said backpack being a load carrier frame.

10. The pelvic belt with abdominal support of claim 5, said backpack being a bad carrier.

11. A weight bearing abdominal support system for back borne load carrying comprising:

a back borne load carrier equipped with at least one shoulder strap, a belt of sufficient length to encircle the pelvic region of a user, said belt being attached to said load carrier and having fastening means for securing about the pelvic region of said user, said belt further configured with an abdominal support element positionable for broad area contact with the abdomen of said user and held in said contact under pressure when said fastening means is operated, said abdominal support element being a primary pad member having an inner surface and an outer surface, the length of said pad member being at least one half and less than the full distance between bony landmarks created by the Anterior/Superior Iliac Spines (ASIS) of a user's pelvis, the width of said pad member being at least one half the distance between said user's lower costal margin and mid inguinal ligament, said inner surface of said pad member being engageable with user's abdomen for distributing a backpack load over a relatively wide area of said user's abdomen when said belt is secured about said user's pelvic region.

12. The weight bearing abdominal support system of claim 11 said load carrier being a backpack.

13. The weight bearing abdominal support system of claim 11 said load carrier being a baby carrier.

14. The weight bearing abdominal support system of claim 11, said load carrier being a school bag.

15. The weight bearing abdominal support system of claim 11, said belt further comprising a lumbar support element positionable for broad area contact with the lumbar region of said user and held in said contact under pressure when said fastening means is operated.

16. The weight bearing abdominal support system of claim 11, further comprising an inflatable abdominal bladder of substantially the same size as said abdominal support element, said abdominal bladder disposed between said abdominal support element and said user's abdomen, said at least one shoulder strap being two shoulder straps, said shoulder straps being configured with inflatable bladders disposed thereon so as to contact the shoulders of said user when said system is donned, a lumen connecting all said bladders, and means for inflating all said bladders.

17. The weight bearing abdominal support system of claim 16, said belt further comprising:

a lumbar support element positionable for broad area contact with the lumbar region of said user and held in said contact under pressure when said fastening means is operated, and an inflatable lumbar bladder of substantially the same size as said lumbar support element, said lumbar bladder disposed between said lumbar support element and said user's lumbar region.

18. The weight bearing abdominal support system of claim 16, said belt attached to said load carrier by means comprising cantilevered left and right side attachment structures extending forward from said load carrier and attached to said belt at respective left and right said attach points.

19. An abdominal support pad for use with a backpack with a pelvic belt, said pad comprising a substantially rigid, primary pad member having an inner surface and an outer surface, the length of said pad member being at least one half and less than the full distance between bony landmarks created by the Anterior/Superior Iliac Spines (ASIS) of a user's pelvis, the width of said pad member being at least one half the distance between said user's lower costal margin and mid inguinal ligament, said inner surface of said pad member being engageable with user's abdomen for distributing a backpack load over a relatively wide area of said user's abdomen when said belt is secured about said user's pelvic region.

20. The abdominal support pad of claim 19, said abdominal support pad further comprising means for securing said pad member to the pelvic belt opposite said backpack.

* * * * *